US005498771A

United States Patent [19]

Mansour et al.

[11] Patent Number: 5,498,771

[45] Date of Patent: Mar. 12, 1996

[54] MINIATURIZED DIELECTRIC RESONATOR FILTERS AND METHOD OF OPERATION THEREOF AT CRYOGENIC TEMPERATURES

[75] Inventors: Raafat R. Mansour, Waterloo; Van Dokas, Cambridge, both of Canada

[73] Assignee: Com Dev Ltd., Cambridge, Canada

[21] Appl. No.: 161,256

[22] Filed: Dec. 3, 1993

[51] Int. Cl.[6] ..... H01P 7/10; H01P 1/20; H01B 12/06

[52] U.S. Cl. ..... 505/210; 505/700; 505/866; 333/202; 333/219.1; 333/99 S

[58] Field of Search ..... 333/995, 202, 333/219.1; 505/210, 700, 701, 866

[56] References Cited

U.S. PATENT DOCUMENTS

| | | | |
|---|---|---|---|
| 3,237,132 | 2/1966 | Okaya | 333/219.1 X |
| 4,521,746 | 6/1985 | Hwan et al. | 333/219.1 X |
| 4,939,489 | 7/1990 | Crueble et al. | 333/219.1 X |
| 5,083,102 | 1/1992 | Zaki | 333/202 X |
| 5,179,074 | 1/1993 | Fiedziuszko et al. | 333/995 X |

OTHER PUBLICATIONS

Pao, Chia–Shan, et al; "A Superconducting—Dielectric Resonator at W–Band", 1988 *IEEE MTT–S Digest*; vol. 1, 0–5 25–27 May 1988; New York, New York; pp. 457–458.

*Primary Examiner*—Benny T. Lee
*Attorney, Agent, or Firm*—Daryl W. Schnurr

[57] ABSTRACT

Microwave bandpass filters contain dielectric resonators mounted in dielectric blocks, which are in turn mounted in cavities. There can be more than one dielectric resonator per cavity. Significant size reduction has been achieved over prior art filters. The filters can be operated at cryogenic temperatures and since the results attainable at cryogenic temperatures are repeatable, the filters can be tuned at cryogenic temperatures and returned to room temperature before being returned to cryogenic temperatures for operating purposes. When operated at cryogenic temperatures, the filters contain shorting plates having high temperature superconducting material thereon. The filters can be constructed with various configurations and can be operated in either a single mode or a dual-mode. Previous single mode or dual-mode dielectric resonator filters are larger in size and mass than the filters of the present application.

28 Claims, 15 Drawing Sheets

MINIATURIZED DIELECTRIC RESONATOR FILTERS AND METHOD OF OPERATION THEREOF AT CRYOGENIC TEMPERATURES

BACKGROUND OF THE INVENTION

1. Field of the Invention

This invention relates to microwave bandpass filters and to a method of operating said filters and, more particularly, to further substantial miniaturization achievable in dielectric resonator filters where mass and size of the filters are critical and to a method of operating said filters at cryogenic temperatures.

2. Description of the Prior Art

It is known that the use of dielectric resonators in microwave filters results in a significant reduction in size and mass while maintaining a performance comparable to that of waveguide filters without dielectric resonators. A typical dielectric resonator filter consists of a ceramic resonator disc mounted in a particular way inside a metal cavity. In addition to miniaturization, loss performance as well as thermal and mechanical stability are also important considerations in the design of dielectric resonator filters.

For dielectric resonator filters, the size of the cavity can be substantially reduced by mounting the dielectric resonator along a base wall of the cavity rather than mounting the resonator in a centre of the cavity. However, when the resonator is mounted on a base wall of the cavity, the Q of the resonator may be reduced and it may be difficult to mount the resonator inside the cavity. Further, current resonator mountings may not withstand the mechanical vibrations that are necessary when the filter is used in space applications.

Single, dual and triple mode dielectric resonator waveguide filters are known (See U.S. Pat. No. 4,142,164 by Nishikawa, et al. issued Feb. 27th, 1979; U.S. Pat. No. 4,028,652 by Wakino, et al. issued Jun. 7th, 1977; Paper by Guillon, et al. entitled "Dielectric Resonator Dual-Mode Filters", Electron Lett, Volume 16, pages 646 to 647, Aug. 14th, 1980; U.S. Pat. No. 4,489,293 by Fiedziuszko issued Dec. 18th, 1984; U.S. Pat. No. 4,453,146 by Fiedziuszko issued Jun. 5th, 1984; U.S. Pat. No. 4,652,843 by Tang, et al. issued Mar. 24th, 1987; U.S. Pat. No. 4,675,630 by Tang, et al. issued Jun. 23rd, 1987; U.S. Pat. No. 5,083,102 by Zaki issued Jan. 21, 1992.).

U.S. Pat. No. 5,179,074 was issued on Jan. 12th, 1993 to Fiedziuszko, et al. and describes a hybrid dielectric resonator high temperature superconductor filter which utilizes a plurality of resonators in a cavity where each resonator is spaced from a conductive wall of the cavity by a superconductive layer. The superconductive layer is capable of superconducting at temperatures as high as about 77° K. A heat exchanger is used to maintain the housing at or below the critical temperature of the superconductor. The filter uses a heat exchanger or other temperature control means to cool the structure to maintain a superconductive sheet below the critical temperature for superconduction. The filter as described cannot achieve the standard of miniaturization achieved by the present invention and, among other differences, does not disclose the use of dielectric blocks. U.S. Pat. No. 4,881,051 by W. C. Tang, et al. issued Nov. 14th, 1989 describes a dielectric image-resonator multiplexer but does not suggest the structure of the present invention and is not capable of achieving the miniaturization achieved with the present invention.

SUMMARY OF THE INVENTION

It is an object of the present invention to provide a dielectric resonator filter that can be used in conventional and cryogenic applications. It is a further object of this invention to provide a dielectric resonator filter that is compact in size with a remarkable loss performance compared to previous filters.

It is still a further object of the present invention to provide a dielectric resonator filter in which thermal stability problems associated with operation of previous filters at cryogenic temperatures have been reduced or eliminated.

A microwave filter has in combination at least one cavity with a dielectric block disposed therein. There is at least one dielectric resonator and shorting plate connected thereto and being located within the block. The block has a size and shape relative to the cavity so that the block fits tightly within the cavity. The block has an interior with a size and shape to hold the dielectric resonator and the shorting plate within the block in a fixed position. The cavity resonates in at least one mode at the resonant frequency of said cavity, there being a respective tuning screw for each mode and for each resonator within said cavity. There is one coupling screw for every two modes that are coupled within the cavity. The block has suitable openings to accommodate the screws. The filter has an input and an output operatively connected thereto.

A method of operating a microwave filter having at least one cavity with a dielectric block disposed therein, with at least one dielectric resonator and associated shorting plate connected thereto, the dielectric resonator and associated shorting plate being located within the block, the block being sized and shaped relative to said cavity so that the block fits tightly within the cavity, the block having an interior that is sized and shaped to hold the dielectric resonator and said associated shorting plate within the block in a fixed position, the cavity resonating in at least one mode at its resonant frequency, there being sufficient tuning and coupling screws, the filter having an input and output, the block being made out of ceramic materials of low loss tangent, the associated shorting plate having a surface adjacent the resonator that is plated with high temperature ceramic materials that become superconductive at cryogenic temperatures, the method comprising lowering the temperature of the associated shorting plate to cryogenic temperatures, tuning the filters, raising the temperature of the associated shorting plate to room temperature, lowering the temperature of said shorting plate to a cryogenic temperature and operating the filter at cryogenic temperatures.

DESCRIPTION OF A PREFERRED EMBODIMENT

Figure 1:
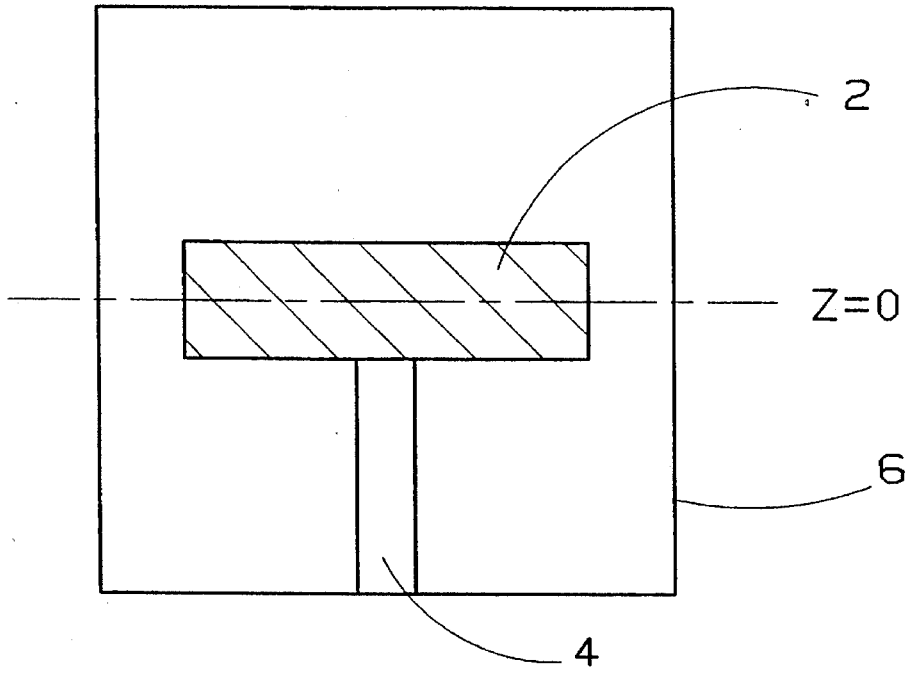
FIGURE 1 (PRIOR ART)
FIG. 1 is a schematic side view of a prior art dielectric resonator cavity where a resonator is mounted at a centre of said cavity.
Figure 2:
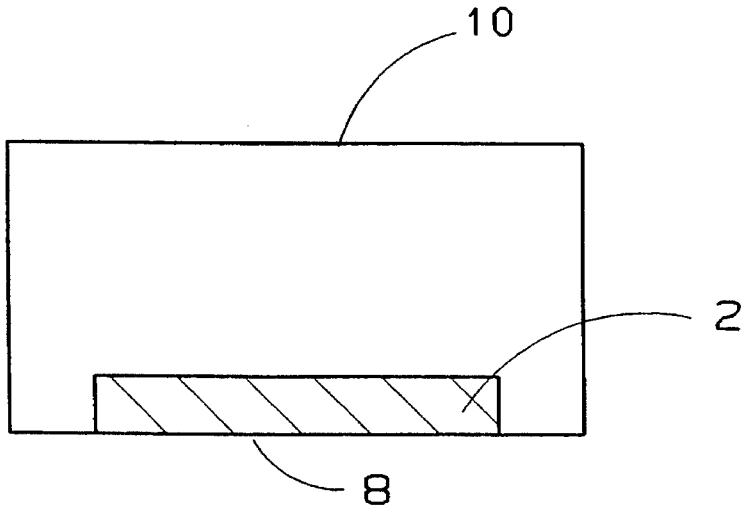
FIGURE 2 (PRIOR ART)
FIG. 2 is a schematic side view of a prior art dielectric resonator cavity where a resonator is mounted directly on a bottom surface of said cavity.

FIG. 1 shows a dielectric resonator 2 located on a support 4 in a cavity 6. The resonator 2 is supported in a plane z=0 in which the tangential field of any of the HEE, TEE or TEM modes vanishes. In FIG. 2, the same reference numerals as those used in FIG. 1 are used to describe the same components. A dielectric resonator 2 is mounted on a base 8 of a cavity 10. The base 8 is a conducting wall that will not change the resonant frequencies of the modes and can therefore be used to reduce the size of the cavity 10 compared to the cavity 6. However, the conducting plane or base S may degrade the Q of the resonator and will make it difficult to mount the resonator inside the cavity. It is therefore important to devise a support for the resonator which maximizes the resonator loaded Q while withstanding mechanical vibrations in meeting the filter thermal requirements.

For use of a filter at cryogenic temperatures, the loaded Q of the resonator will be improved by replacing the conducting plate shown in FIG. 2 by ceramic materials that become superconducting at liquid nitrogen temperatures. The loss tangent of dielectric resonator materials decreases as the temperature decreases. Therefore, by combining high temperature superconducting materials with dielectric resonators, it is possible to achieve a dielectric resonator filter with superior loss performance for cryogenic applications. These filters have tuning screws that have to be tuned at cryogenic temperatures. It is essential that the performance of these filters be repeatable as temperature changes from cryogenic to room temperature and then back to cryogenic.

Figure 3:
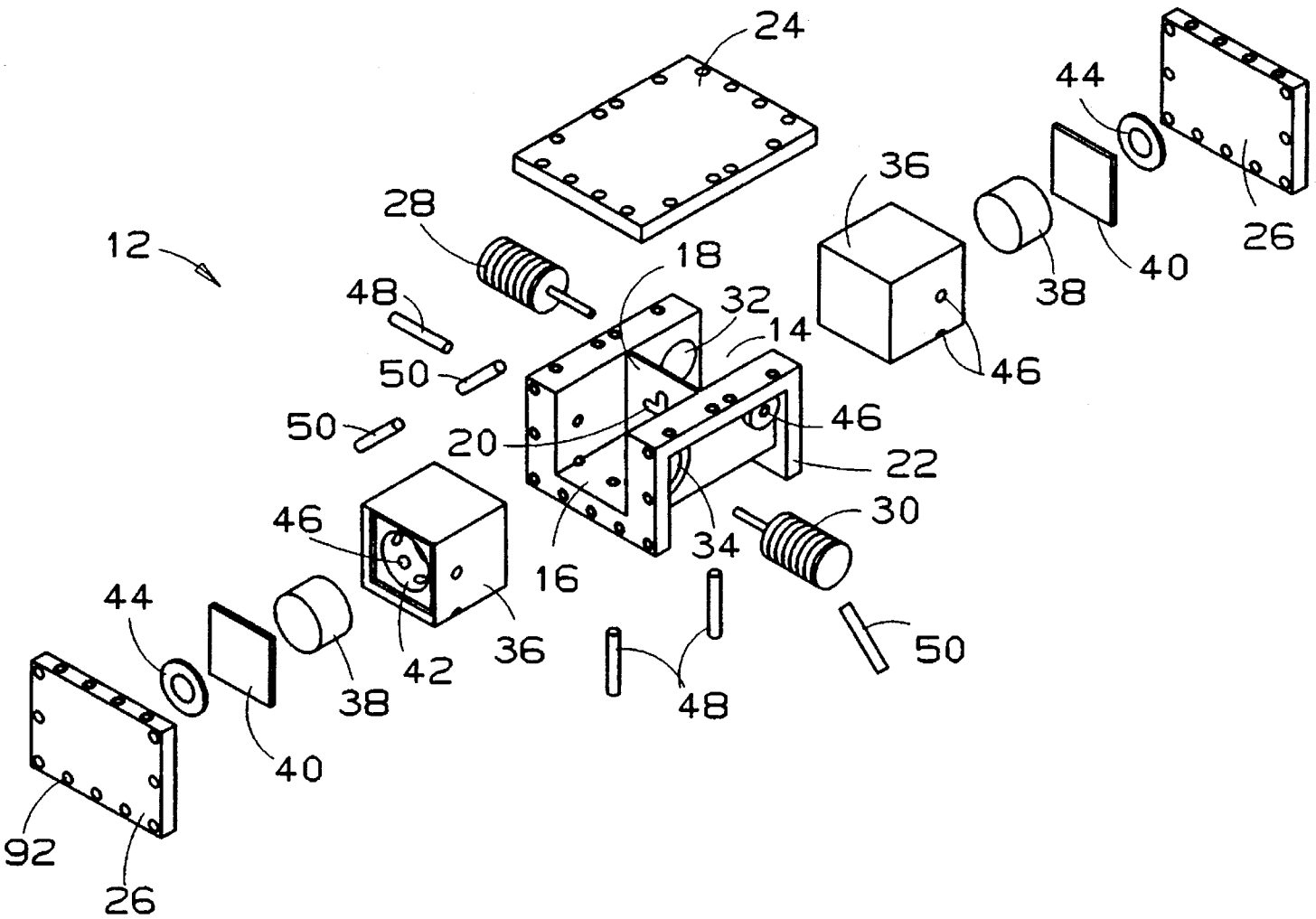
FIG. 3 is an exploded perspective view of a dielectric resonator filter in accordance with the present invention, said filter having two cavities with one dielectric resonator in each cavity, said two cavities being separated by an iris.

In FIG. 3, a dielectric resonator filter 12 has two cavities 14, 16 that are separated by an iris 18 containing an aperture 20. The iris 18 could be in the form of a rectangular slot, a cross-slot or various other forms. The aperture is shown only partially but is a cruciform aperture. The filter 12 has a housing 22 that includes a cover 24 and two end plates 26. The housing 22 can be made of any known metallic materials that are suitable for waveguide housings, for example, Invar. Screws to secure the cover 24 and end plates 26 onto the housing 22 are not shown. The filter has an input 28 and output 30, said input and output being probes that are mounted in holes 32, 34 respectively of the housing 22. Each cavity 14, 16 contains a dielectric block 36, which in turn contains a dielectric resonator 38 and a shorting plate 40 connected thereto. The block 36 is sized and shaped to substantially fill the cavity in which it is located. The block 36 is solid except for a hollowed portion 42 that corresponds to a size and shape of each resonator 38 and shorting plate 40. The block 36 fits tightly within the cavity in which it is located and the resonator 38 and shorting plate 40 in turn are held snugly within the block 36 in a fixed position. Springs 44 are preferably made out of stainless steel and are inserted between the end plates 26 and the shorting plates 40 to urge the shorting plate 40 into good contact with the resonator 38. The housing 22 as well as the block 36 contains suitable openings 46 to receive tuning and coupling screws 48, 50. In operation, the filter 12 can be operated in a dual HEE mode to realize a four-pole dual-mode response or a TEE mode to realize a two-pole single mode filter or a TME mode to realize a two-pole single mode filter. The filter 12 shown in FIG. 3 operates in a dual-mode. Energy is coupled into the cavity 14 through input probe 28. Energy is coupled between the two modes within the cavity 14 by coupling screw 50 and is coupled through the aperture 20 into the cavity 16. Energy within the cavity 16 is coupled between the two modes by coupling screw 50 and exits the cavity 16 through the output 30. It can be seen that the blocks 36 are sized and shaped to substantially fill each of the cavities 14, 16.

Figure 4:
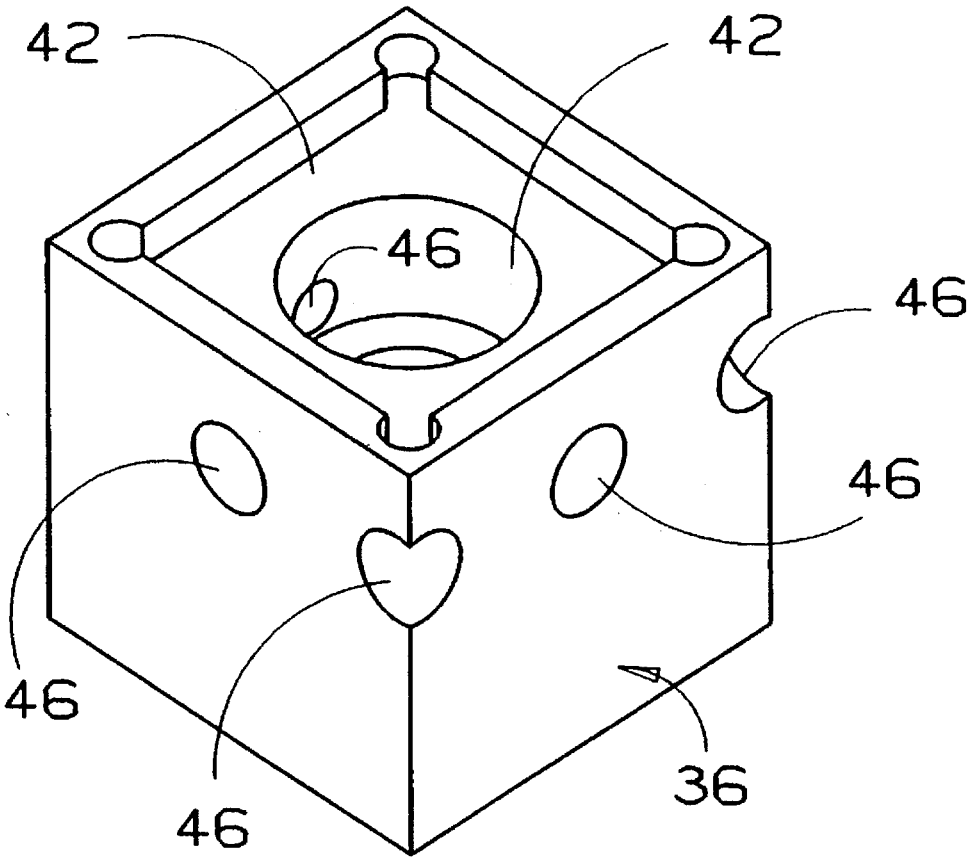
FIG. 4 is a partially cut-away perspective view of a dielectric block used in the filter shown in FIG. 3.

In FIG. 4, there is an enlarged perspective view of a block 36. It can be seen that the hollow portion 42 has a cylindrically-shaped section that is sized to receive the resonator 38 (not shown) and a square section adjacent thereto that is sized and shaped to receive the shorting plate 40 (not shown). It can also be seen that when inserted, the resonator 38 and shorting plate 40 (not shown in FIG. 4) will fit snugly within the hollowed portion 42. The openings 46 are sized and located to receive tuning and coupling screws (not shown in FIG. 4).

Figure 5:
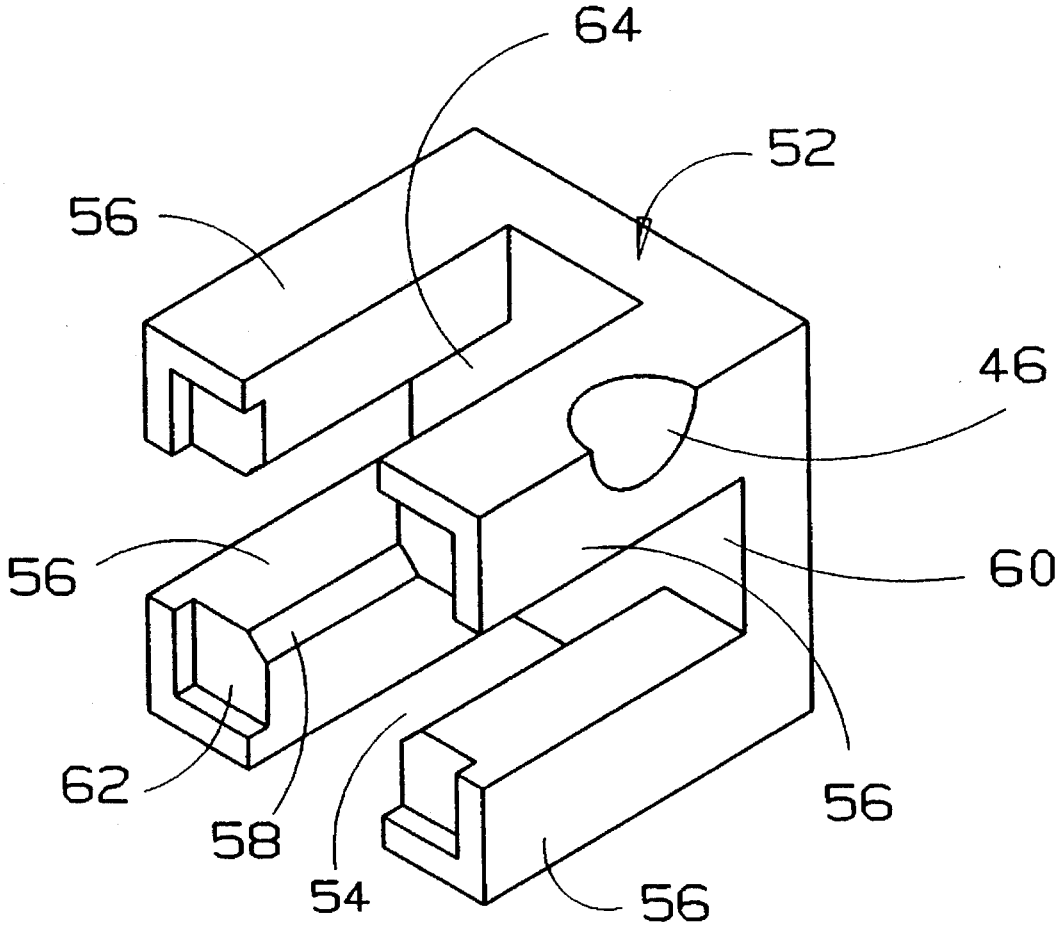
FIG. 5 is a perspective view of a further embodiment of a block.

In FIG. 5, there is shown a perspective view of a block 52, which is a further embodiment of a block that can be used as an alternative to the block 36. The block 52 has an interior 54 that is sized and shaped to receive the cylindrical resonator 38 (not shown in FIG. 5) and the shorting plate 40 (not shown in FIG. 5). The block 52 has four legs 56 that are identical to one another. Each leg 56 has an arc-shaped interior surface 58. The resonator 38 (not shown) rests against these arch-shaped surfaces 58 and against a base 60 so that the resonator is snugly supported within the block 52. The shorting plate is supported on shoulders 62 of each of the legs 56. The shorting plate is also supported snugly on said shoulders. The block 56 has openings 46, 64 to receive tuning and coupling screws 48, 50 (not shown in FIG. 5).

The openings 46 could be blind holes or through holes. The outside dimensions of the block 52 are chosen so that the block fits snugly within the cavity. The inside dimensions are chosen so that the resonator and shorting plate fit snugly within the block. In comparison with the block 36, with the block 52 material has been removed to reduce the mass and to improve the loss performance.

Figure 6:
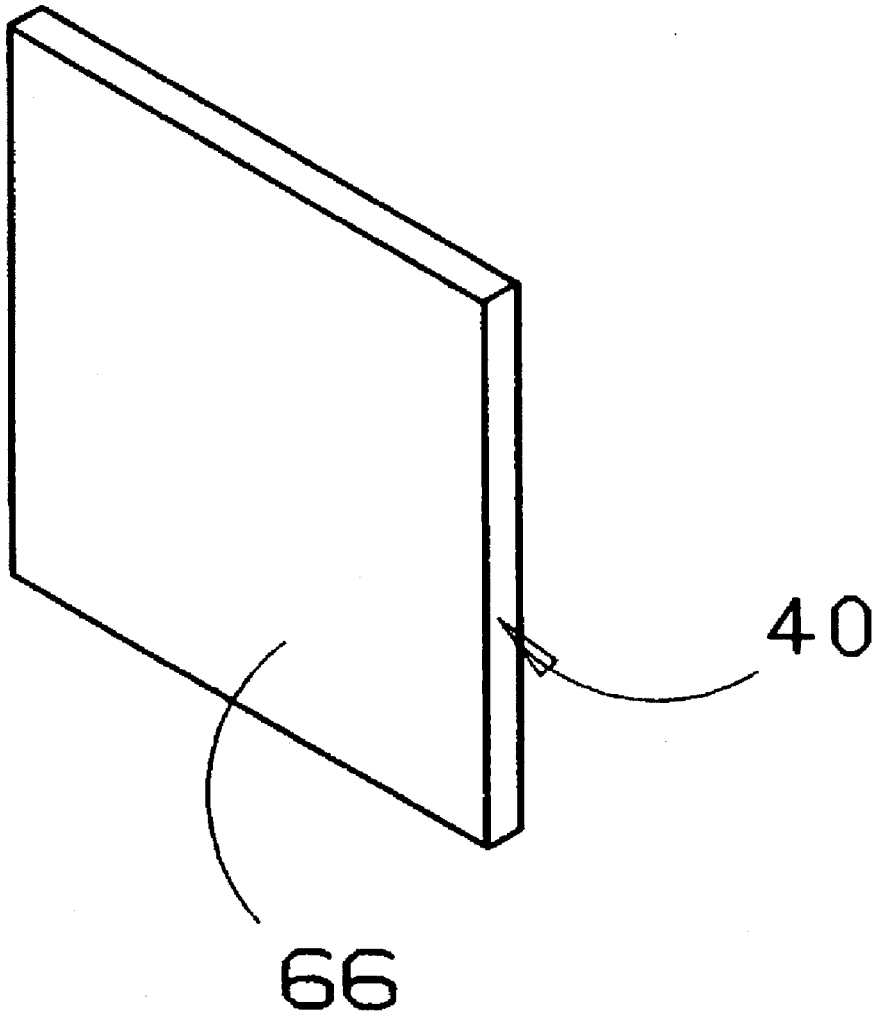
FIG. 6 is a perspective view of a shorting plate made of Invar with one surface thereof plated with a suitable metal.

In FIG. 6, there is shown a shorting plate 40 having a surface 66 that contacts the resonator 38 (not shown in FIG. 6) when the shorting plate and resonator are installed within a block (not shown). The contact surface 66 is plated with silver or gold in order to reduce the RF losses.

Figure 7:
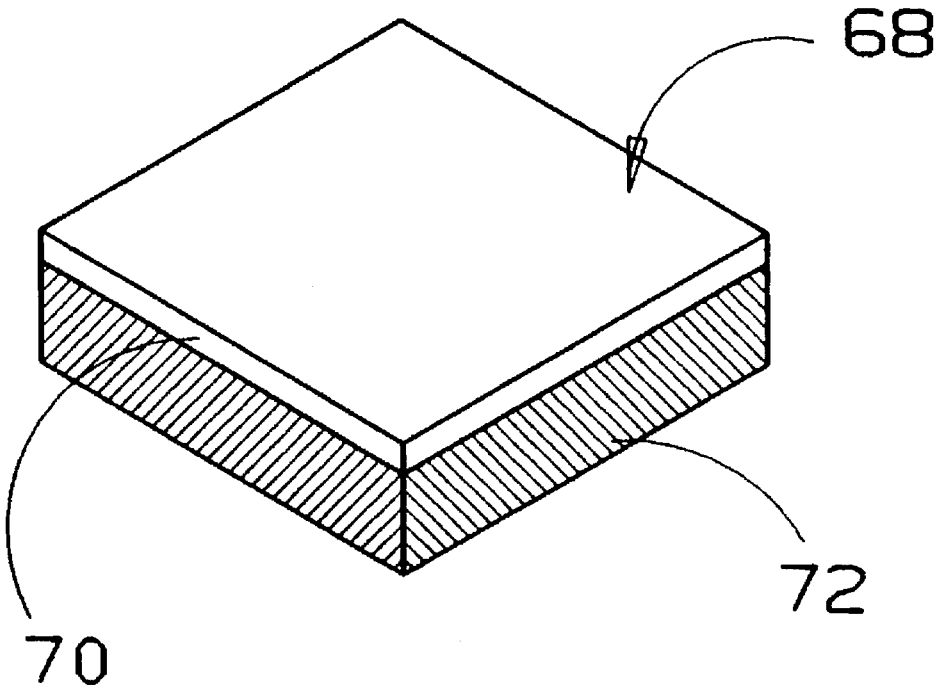
FIG. 7 is a perspective view of a shorting plate made of a dielectric substrate with one surface thereof coated with a suitable metal or high temperature ceramic material.

In FIG. 7, in a further embodiment, a shorting plate 68 has a contact surface 70, which is a thin film layer made out of gold or silver deposited on a dielectric substrate 72. The shorting plates 40, 68 shown in FIGS. 6 and 7 can be used in the filter 12 for cryogenic or conventional room temperature applications. For cryogenic applications, the thin film layer for the contact surface of the shorting plate can be made out of high temperature ceramic materials that become superconductive at cryogenic temperatures (e.g. 77° K. or lower) such as yttrium barium copper oxide (YBCO) or thallium barium copper calcium oxide (TBCCO). The dielectric substrate 72 can be made out of lanthium aluminate or sapphire or any other suitable dielectric substrate material. The use of high temperature superconductive materials, rather than gold or silver significantly improves the loss performance of the dielectric resonator filter for cryogenic applications.

It is not necessary that the shorting plate has a square shape. The shorting plate could be rectangular, circular or any other shape of any size so long as it is large enough to cover the circular cross-sectional shape of the dielectric resonators. The dielectric blocks could also be any suitable shape so long as they are sized and shaped to fit snugly within the cavity and have an interior that is sized and shaped to snugly support the dielectric resonator and shorting plate. For example, the blocks could have a cylindrical shape and still be used in a square or rectangular-shaped cavity so long as they are sized to fit snugly within the cavity. Further, if the cavity had a cylindrical shape, the blocks could have a square rectangular shape or a cylindrical shape so long as they had a size and shape to fit snugly within the cavity.

Figure 8:
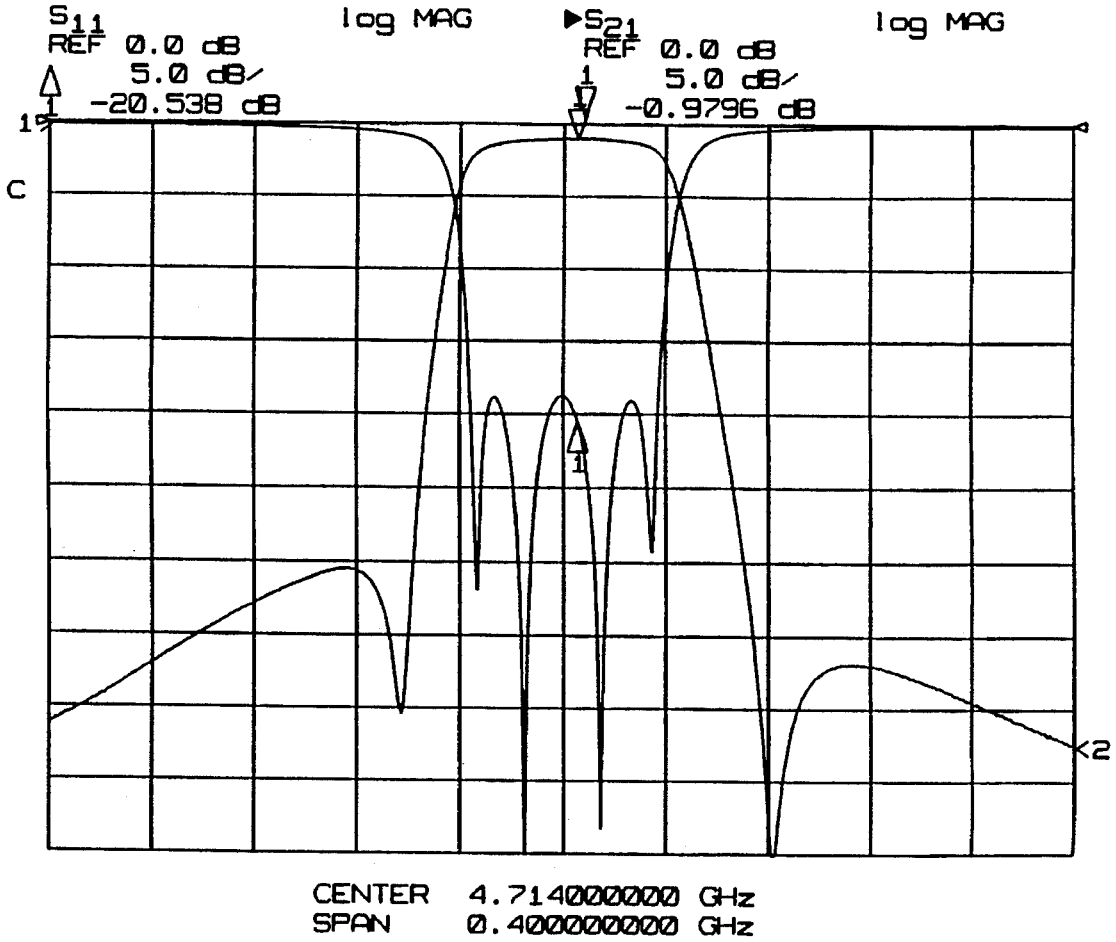
FIG. 8 is a graph illustrating the RF performance of a dielectric resonator filter described in FIG. 3 where blocks of said filter are made out of sapphire.
Figure 9:
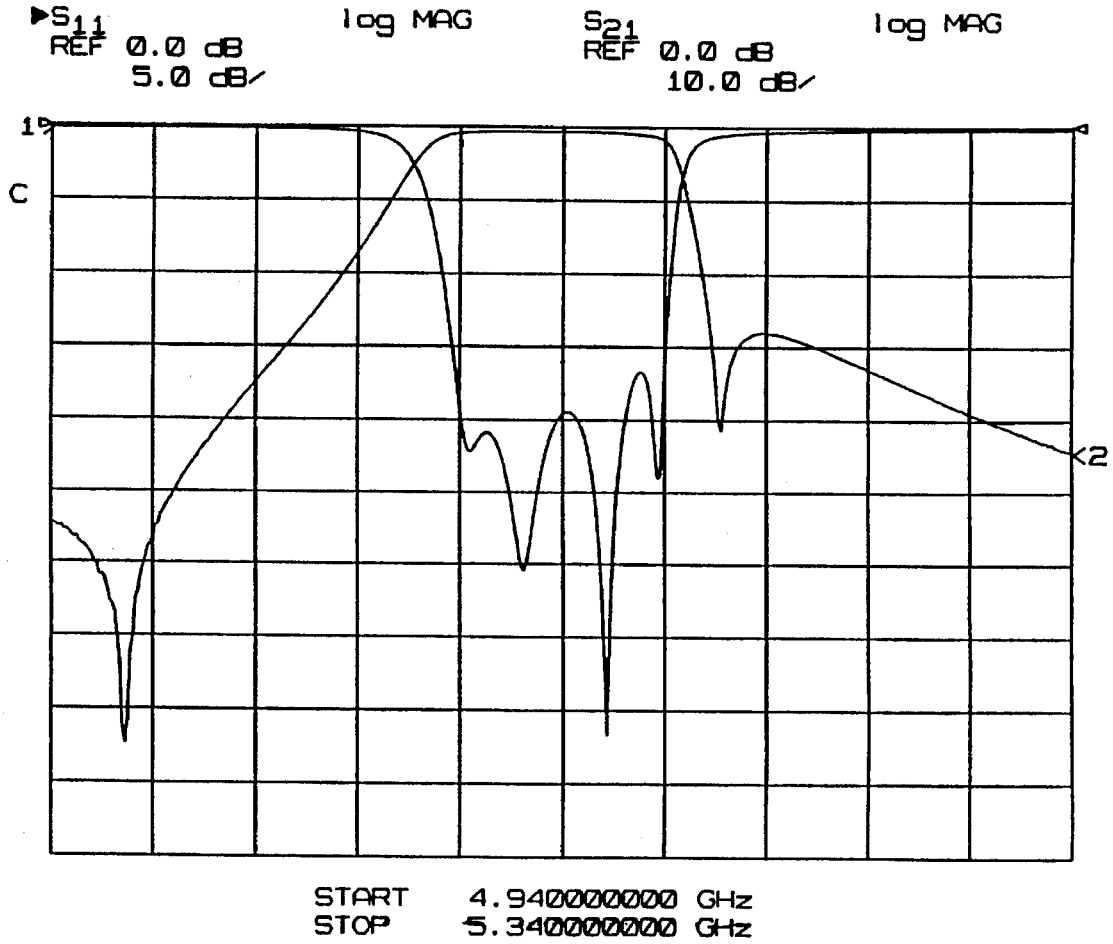
FIG. 9 is a graph illustrating the RF performance of the dielectric resonator filter described in FIG. 3 where the blocks of the filter are made of D4 (a trade name of TRANS-TECH)

FIGS. 8 and 9 respectively illustrate the insertion loss and return loss of a four-pole filter as described in FIG. 3 measured at room temperatures. The results in FIG. 8 were achieved with the blocks 36 made out of sapphire while those in FIG. 9 were achieved with the blocks 36 made out of D4 (a trade mark). The shorting plates 40 used for both FIG. 8 and FIG. 9 were made out of silver plated Invar. Although conventional dielectric resonators can be designed to provide a similar RF performance, they will be considerably larger in size and mass. The size and mass reduction of filters constructed in accordance with the present invention can be more than 50% compared to conventional dielectric resonator filters. When compared to the planar dual-mode filter design described in U.S. Pat. No. 4,652,843, size savings of 80% and mass savings of 50% have been achieved.

Figure 10A:
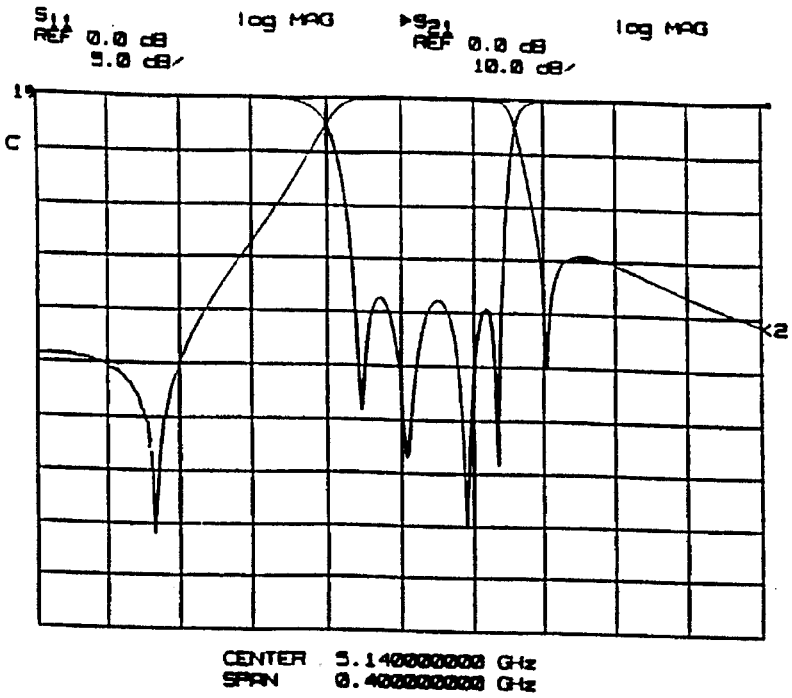
FIG. 10*a* is a graph showing the RF performance of a dielectric resonator filter disclosed in FIG. 3 before vibrations.
Figure 10B:
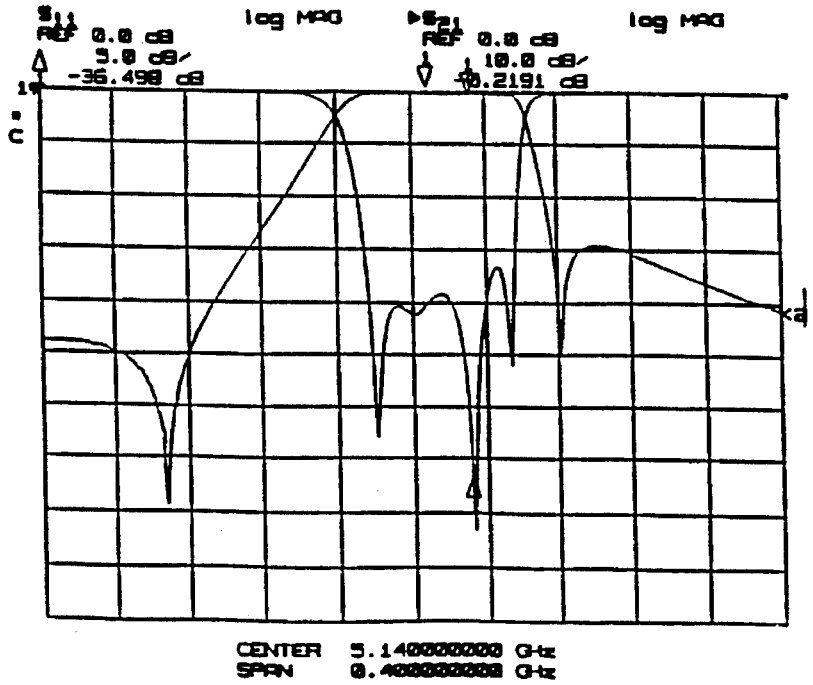
FIG. 10*b* is a graph showing the RF performance of a dielectric resonator filter disclosed in FIG. 3 after vibration.

When used in space applications, the filter must be capable of surviving stringent mechanical vibrations. FIG. 10*a* shows the insertion loss and return loss results of a filter constructed in accordance with FIG. 3 before being exposed to typical space-application vibration levels and FIG. 10*b* shows the insertion loss and return loss results after vibration. It can be seen that the results in FIGS. 10*a* and 10*b* are essentially the same and that therefore a filter constructed in accordance with the present invention is capable of withstanding space-application vibration levels.

Figure 11:
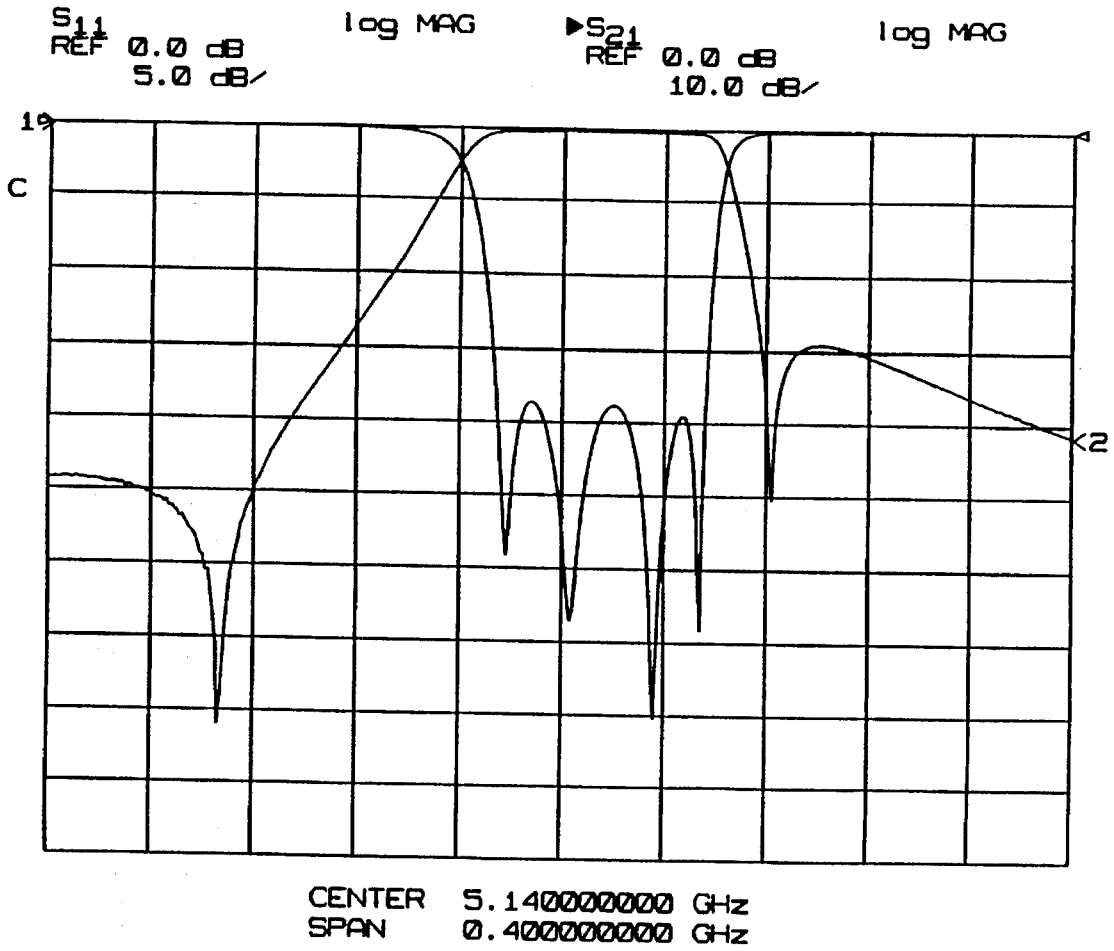
FIG. 11 is a graph showing the RF performance of a dielectric resonator filter shown in FIG. 3 where shorting plates of the filter are made from high temperature superconductive films deposited on a dielectric substrate.

FIG. 11 shows the insertion loss and return loss results of a four-pole dual-mode filter constructed in accordance with FIG. 3 at cryogenic temperatures. The shorting plate 40 used in the filter was the plate 68 described in FIG. 7 with a high temperature superconductive TBCCO thin film layer 70 covering the substrate 72. It can be seen that the filter has a relatively narrow bandwidth (close to 1%) and exhibits a small insertion loss. By comparing the results of FIGS. 9 and 11, it can be seen that the use of high temperature superconductive materials considerably improves the loss performance of the filter.

One of the most important factors in the design of cryogenic narrow band filters is that the filter must be thermally stable to ensure performance repeatability as the temperature changes from cryogenic to room temperatures (i.e. during shipping and storage) and then back to cryogenic temperatures (during testing and operation). The filter described in FIG. 3 was recycled a number of times between cryogenic temperature and room temperature. No performance degradation was observed as the filter was retested at cryogenic temperatures.

Figure 12:
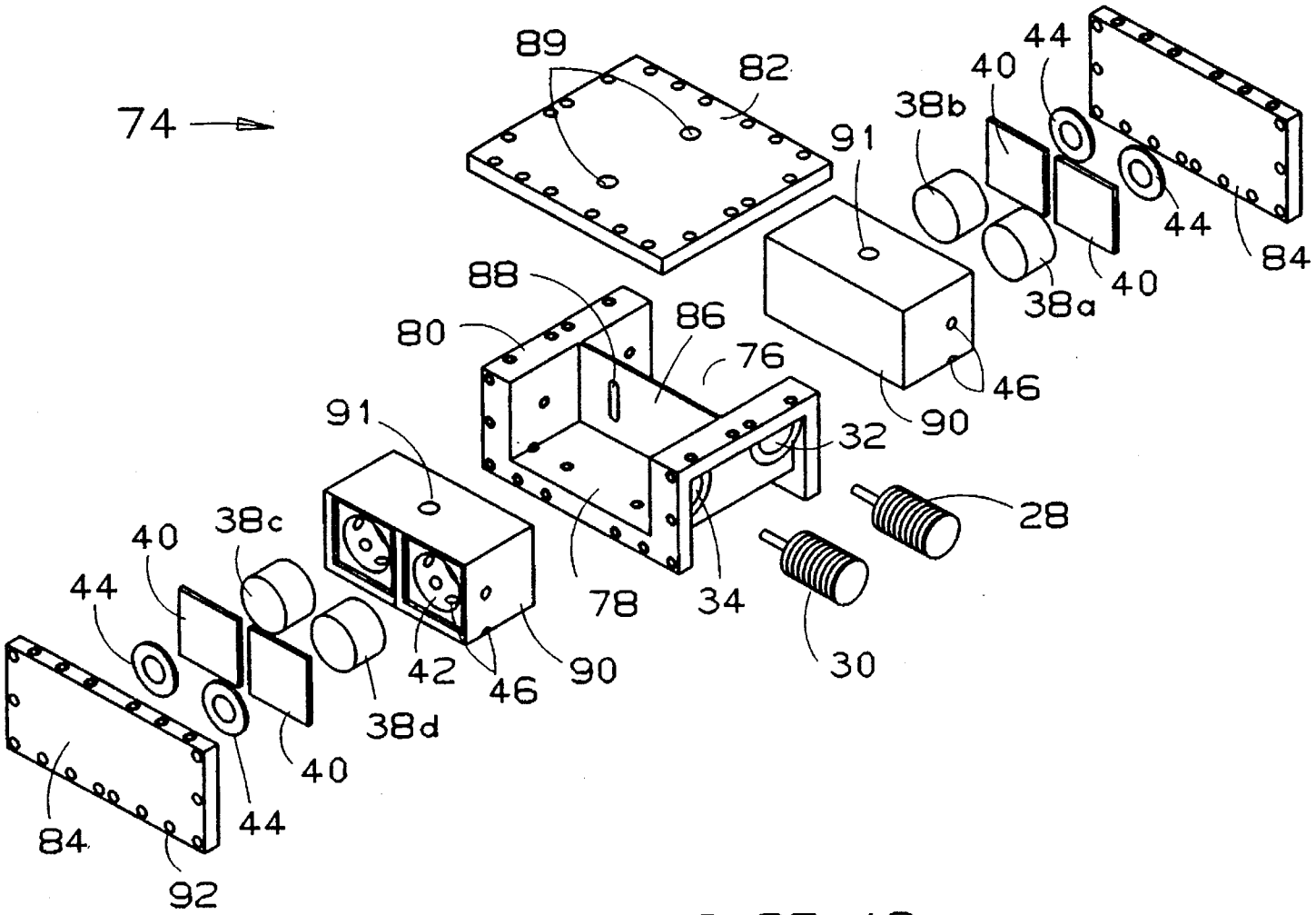
FIG. 12 is an exploded perspective view of a dielectric resonator filter having two cavities with two dielectric resonators in each cavity.

In FIG. 12, there is shown a dielectric resonator filter 74 with two cavities 76, 78 in a housing 80. The same reference numerals are used for those components in FIG. 12 that are the same or similar to components of the filter 12 in FIG. 3. The housing 80 includes a cover plate 82 and two end plates 84. The cavities 76, 78 are separated by an iris 86 containing one aperture 88. As with the filter 12, the aperture can be any suitable shape but the aperture 88 is in the form of a slot. The housing 80, including the cover 82 and end plates 84 can be made of any suitable metal, for example, Invar. The cover 82 has two tapped holes 89 for receiving tuning screws (not shown).

Each of the cavities 76, 78 contains a dielectric block 90 that has two hollowed portions 42. Each hollowed portion receives one resonator 38*a*, 38*b*, 38*c*, 38*d* and shorting plate 40. Springs 44 ensure that good contact is maintained between the shorting plate 40 and the adjacent resonator. Each block 90 has one hole 91 in a top surface thereof to receive the tuning screw (not shown) that extends through each hole 89 of the cover 82. As with the filter 12, the blocks 90 contain various openings 46 for receiving tuning screws (not shown) and coupling screws (not shown). The tuning screws and coupling screws have been omitted to prevent the drawings from becoming too complex. Also, those skilled in the art will have no difficulty placing the tuning and coupling screws. The tuning screws enter the block 90 at a 90° angle and the coupling screws enter the block 90 at a 45° angle. The filter 74 has an input 28 and an output 30 which are mounted in holes 32, 34 respectively in cavity 78. The input and output are probes. Tiny holes 92 around the periphery of the housing 80 including the cover 82 and end plates 84 are sized to receive screws (not shown) so that the various components can be held together.

In operation, the dielectric resonators 38*a*, 38*b*, 38*c* and 38*d* can operate in the HEE mode to realize an eight-pole dual-mode filter or either the TEE mode or the TME mode to realize a four-pole single filter. The blocks 90 support the resonators 38*a*, 38*b*, 38*c* and 38*d* in a bottom portion in each of the cavities 76, 78. The hollowed portions 42 are sized and shaped to snugly receive the resonators 38*a*, 38*b*, 38*c* and 38*d* and the shorting plates 40. Coupling between the dielectric resonators within the same cavity could be controlled by adjusting the spacing between the resonators but is controlled by using tuning screws (not shown) inserted through the cover 82 through tapped holes 89, one hole 89 for each cavity. The holes 89 are aligned with the holes 91 in the blocks 90. The coupling between resonators 38*b* and 38*c* of different cavities 76, 78 respectively is achieved through the aperture 88. Energy enters the cavity 76 through input probe 28 and is coupled between resonator 38*a* of cavity 76 and 38*b* of cavity 76 by the tuning screw (not shown) in the holes 89, 91 of the cavity 76. Energy is coupled from the resonator 38*b* to the resonator 38*c* through the aperture 88. Energy is coupled from the resonator 38*c* to the resonator 38*d* within the cavity 78 by the tuning screw (not shown) in the holes 89, 91 of the cavity 78. Energy is coupled from the resonator 38*d* out of the cavity 78 through the output probe 30.

Figure 13:
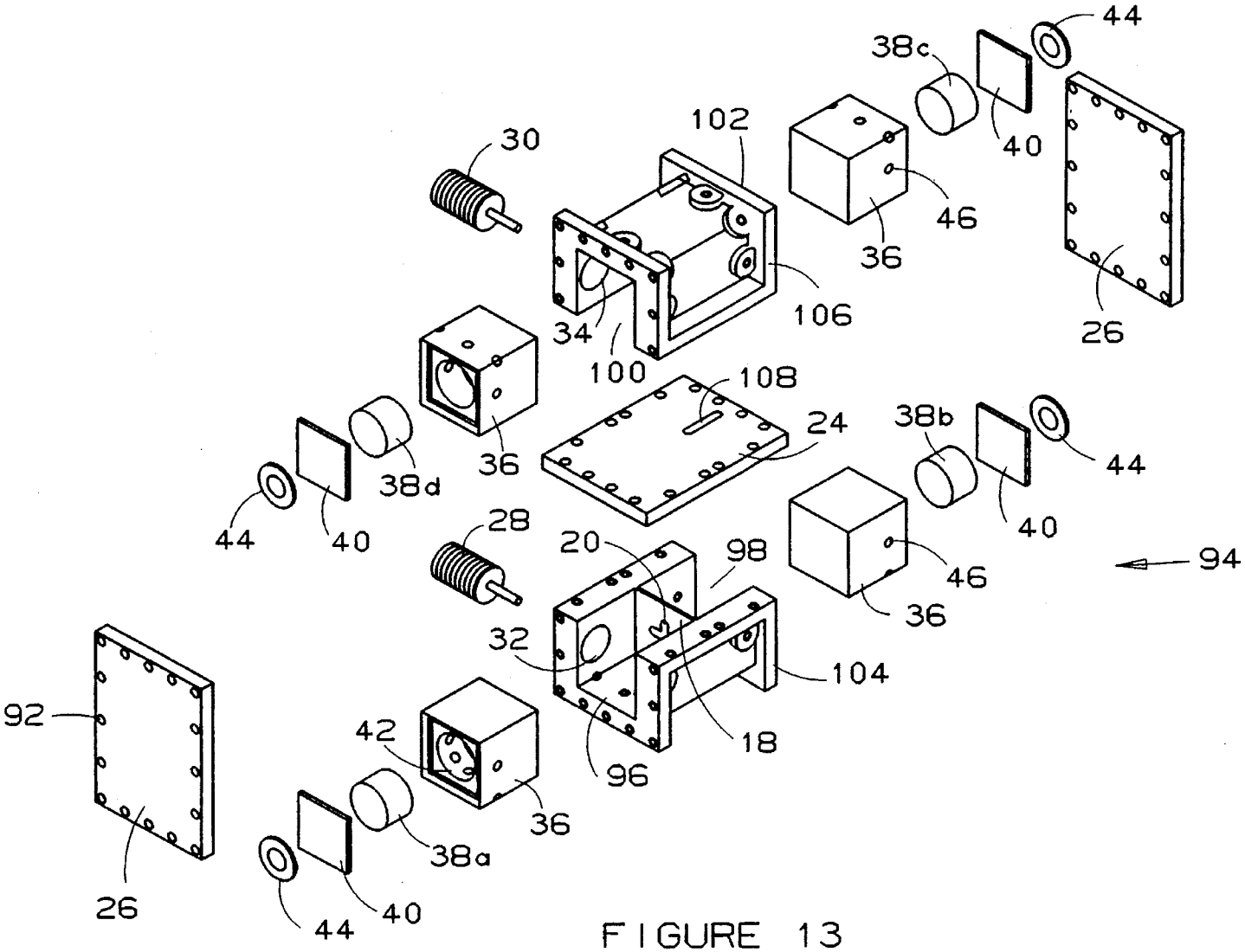
FIG. 13 is an exploded perspective view of a dielectric resonator filter having four cavities with one dielectric resonator in each cavity.

In FIG. 13, there is shown a dielectric resonator filter 94 having four cavities 96, 98, 100, 102 and four dielectric resonators 38*a*, 38*b*, 38*c* and 38*d* respectively. Components of the filter 94 that are the same or similar to those of the filter 12 or the filter 74 have been described using the same reference numeral. In general terms, the filter 94 is very similar to the filter 12 except that the filter 94 has four cavities rather than two cavities. The filter 94 has two housings 104, 106 which are virtually identical to one another except for the location of the holes 32, 34 which receive the input and output probes 28, 30 respectively. Each of the housings 104, 106 share common end plates 26 and share a common cover plate 24. The cavities 96, 98 of the housing 104 are separated by an iris 18 containing an aperture 20. The cavities 100, 102 are also separated by an iris 18 (not shown) containing an aperture (not shown). Each of the cavities has a dielectric block 36 with a hollowed portion 42, a shorting plate 40 and a spring 44. The housings 104,106, the cover 24 and the end plates 26 all have tiny holes 92 around their peripheries so that they can be affixed to one another using screws (not shown). The tuning and coupling screws have been omitted from the drawings for the same reasons as given for FIG. 12.

In operation, the dielectric resonators 38*a*, 38*b*, 38*c*, 38*d* can operate either in a HEE mode, TEE mode or TME mode to achieve either an eight-pole filter or a four-pole filter as previously discussed with respect to filter 74. The embodiment shown in FIG. 13 is set up for dual-mode operation because of the presence of openings 46 at a 45° angle to receive coupling screws. Energy is coupled into the cavity 96 through input probe 28 to the dielectric resonator 38*a*. Energy is coupled between the resonators 38*a* and 38*b* through aperture 20 of the iris 18 located in the housing 104. Energy is coupled between the resonator 38*b* and the resonator 38*c* through a slot 108 in the cover 24. Energy is coupled from the resonator 38*c* to the resonator 38*d* through the aperture 20 (not shown) located in the housing 106. Energy is coupled from the resonator 38*d* to the output through output probe 30. The apertures 20 are shown as having a cruciform shape but can have any suitable shape and can be arranged to provide any filter realization such as Chebyshev, elliptic or linear phase functions.

Figure 14:
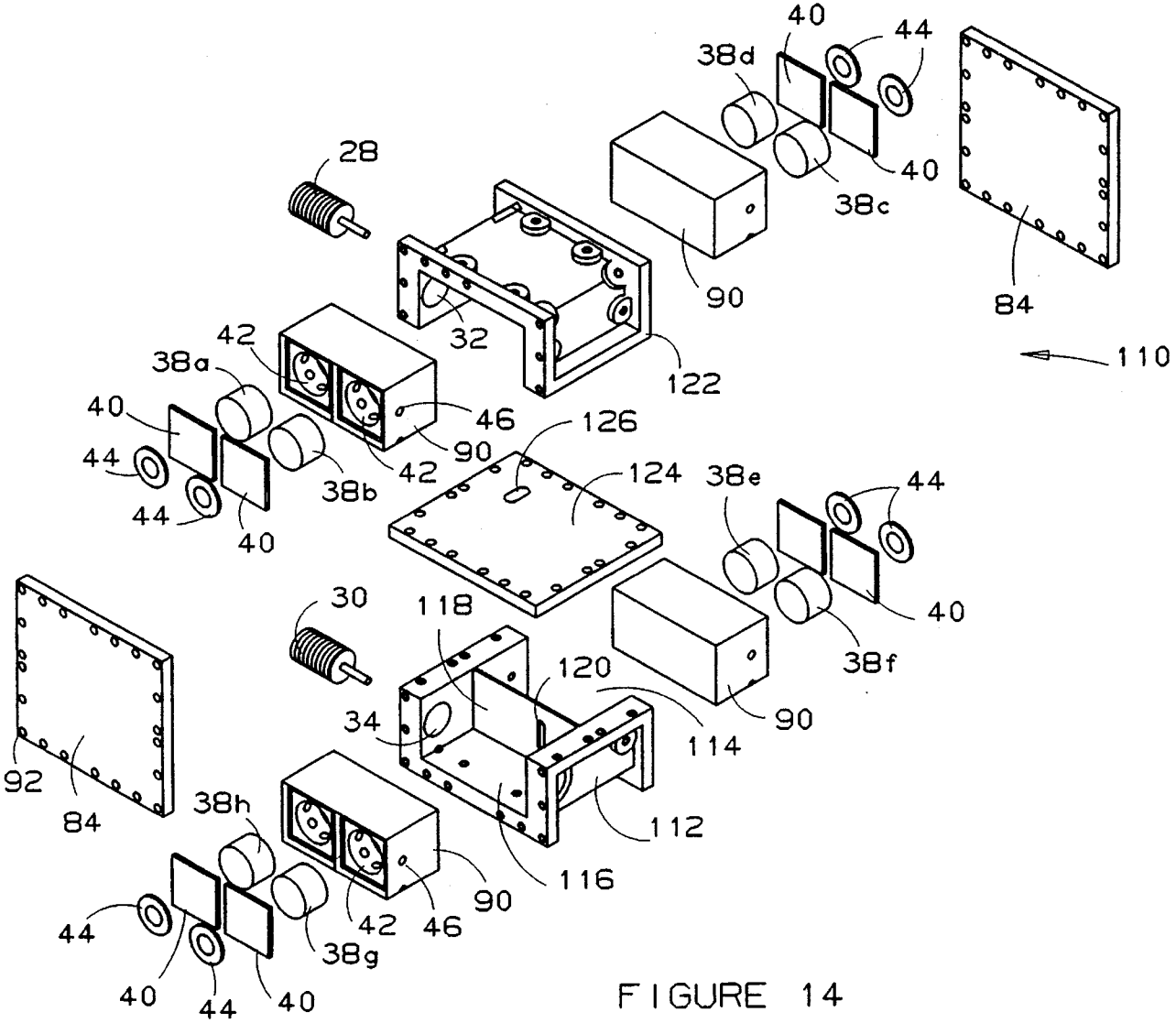
FIG. 14 is an exploded perspective view of a further embodiment of a dielectric resonator filter having four cavities where there are two dielectric resonators located in each cavity.

FIG. 14 shows an eight-pole single mode dielectric resonator filter 110. The filter 110 has eight dielectric resonators 38*a*, 38*b*, 38*c*, 38*d*, 38*e*, 38*f*, 38*g*, 38*h* and has the general configuration of two filters 74 as shown in FIG. 12 combined together. The same reference numerals have been used for the filter 110 for those components that are the same or similar to the components used in the filter 74. A housing 112 has two cavities 114, 116 that are separated by an iris 118 containing an aperture 120. The housings 112, 122 share a cover plate 124 that contains a slot 126 and share common end plates 84. The housing 122 has an iris 118 (not shown) with an aperture 120 (not shown in FIG. 14), the aperture being located between the resonators 38*b* and 38*c*. The tuning and coupling screws have been omitted for the same reasons given for FIG. 12. While the filter 110 could be operated in a single mode or dual-mode, single mode operation is preferred as there is generally no cost advantage to having a 16-pole filter. When the filter 110 is used as a single mode filter, the openings 46 that extend into the blocks 90 at a 45° angle would be omitted because coupling screws are not required.

In operation, energy is coupled into the resonator 38*a* through the input probe 28. Energy is coupled from the resonator 38*a* to the resonator 38*b* by controlling the spacing between the resonators. Energy is coupled from the resonator 38*b* to the resonator 38*c* through the aperture 120 (not shown) in the housing 122. Energy is coupled between the resonator 38*c* and the resonator 38*d* and is controlled by controlling the spacing between these resonators. Energy is coupled from the resonator 38*d* through the slot 126 to the resonator 38*e*. Energy is coupled from the resonator 38*e* to the resonator 38*f* through the spacing between these two resonators. Energy is coupled from the resonator 38*f* through the aperture 120 of the housing 112 through the resonator 38*g*. Energy is coupled from the resonator 38*g* to the resonator 38*h* by controlling the spacing between these resonators. Energy is coupled from the resonator 38*h* out of the filter through the output probe 30. The coupling between adjacent resonators within the same block 90 can, alternatively, be controlled using tuning screws (not shown).

Figure 15:
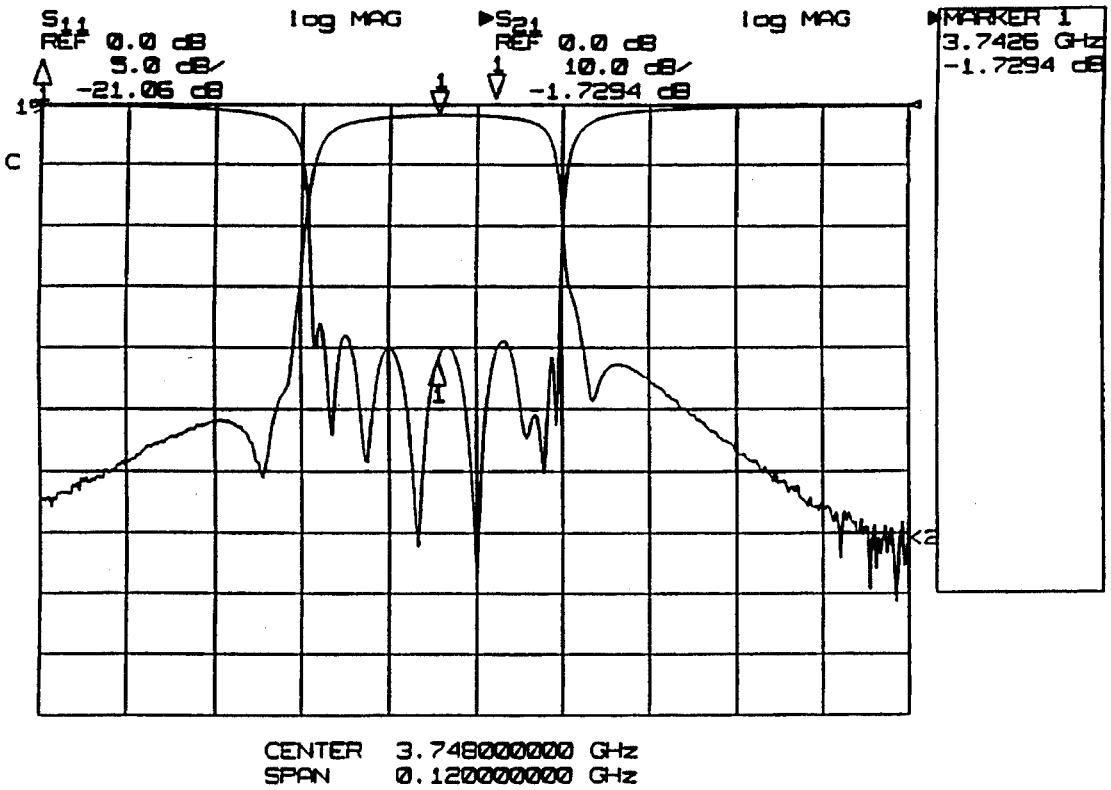
FIG. 15 is a graph showing the RF performance of an eight-pole filter having a shorting plate as described in FIG. 6.
Figure 16:
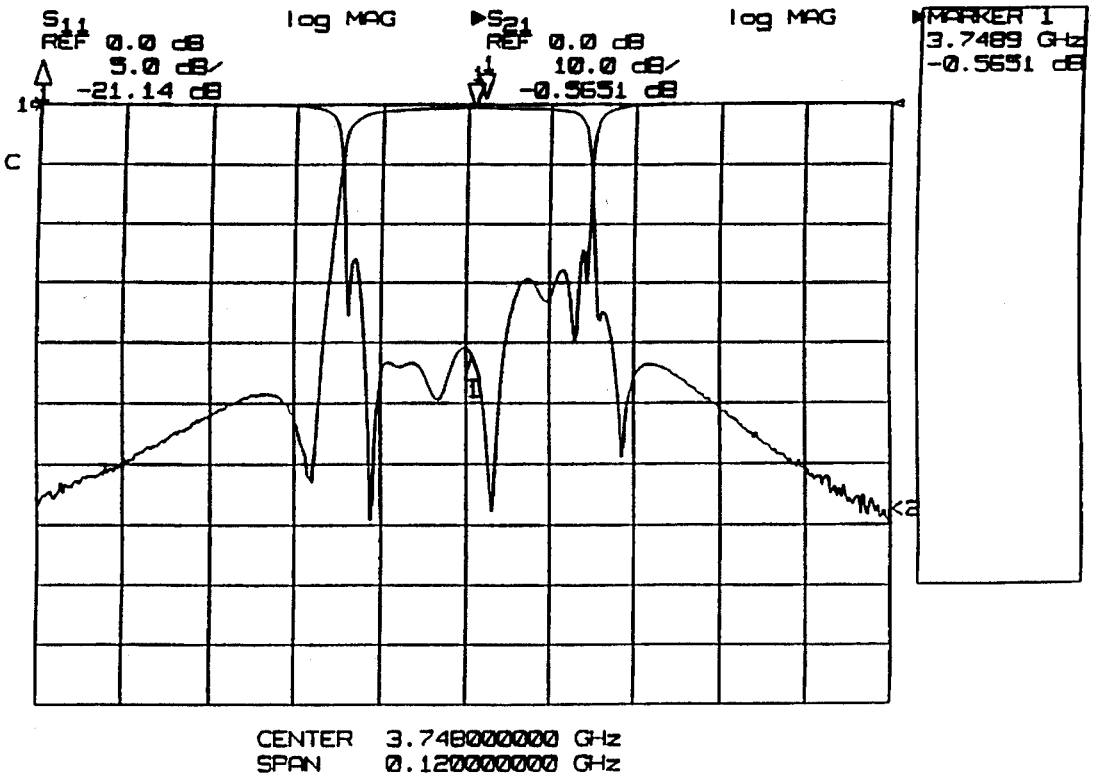
FIG. 16 is a graph showing the RF performance of an eight-pole filter having a shorting plate as described in FIG. 7, said filter operating at cryogenic temperatures.

FIG. 15 shows the measured performance of an eight-pole filter constructed in accordance with the filter 110 shown in FIG. 14. The filter was constructed using the shorting plate shown in FIG. 5 and those results appear in FIG. 15. In FIG. 16, the same filter 110 was used except that the shorting plate shown in FIG. 7 was substituted for the shorting plate shown in FIG. 6 and the filter was operated at cryogenic temperatures. By comparing FIGS. 15 and 16, it can be seen that the insertion loss performance of the filter 110 is considerably improved when the filter is operated at cryogenic temperatures using high temperature superconductive materials for the shorting plates 40.

While various configurations of filters are shown in the drawings, it will be readily apparent to those skilled in the art that other configurations could be utilized as well within the scope of the attached claims. For example, a filter could have three dielectric resonators and could be a three-pole or a six-pole filter, or a filter could have five, six or seven resonators or more than eight resonators. The filter can be operated in either a single mode or a dual mode. A filter can be operated at ambient temperatures or, by using shorting plates having a thin film of high temperature superconductive film thereon, the filter can be operated at cryogenic temperatures. The results shown in the graphs of this application are examples only and are not necessarily the best results attainable using the present invention. Various changes, within the scope of the attached claims, will be readily apparent to those skilled in the art. For example, the cavities could have a cylindrical shape with the blocks remaining square or rectangular or the blocks could have a cylindrical shape with square, rectangular or cylindrical cavities. Various shapes will be suitable for the blocks.

What we claim as our invention is:

1. A microwave filter comprising in combination:

(a) at least one cavity having a at least one dielectric block disposed therein, with at least one dielectric resonator and associated shorting plate connected thereto being located within said block, said block having a size and shape relative to said cavity so that said block fits tightly within said cavity, said block having an interior with a size and shape to hold said dielectric resonator and said shorting plate within said block in a fixed position;

(b) said cavity resonating in at least one mode at the resonant frequency of said cavity, there being a respective tuning screw for each mode and for each resonator within said cavity, and one coupling screw for every two modes that are coupled within said cavity, said block having suitable openings to accommodate said screws;

(c) said filter having an input and an output operatively connected thereto.

2. A filter as claimed in claim 1 wherein the respective block has at least three areas of contact with said corresponding cavity.

3. A filter as claimed in claim 2 wherein there are at least two dielectric resonators contained separately within one block with each resonator having an associated shorting plate.

4. A filter as claimed in any one of claims 1, 2 or 3 wherein the respective block has a size and shape to substantially fill said corresponding cavity.

5. A filter as claimed in any one of claims 1, 2 or 3 wherein the respective block has a size and shape to substantially fill said corresponding cavity, said respective block being solid except for a hollowed portion that corresponds to a size and shape of each resonator and associated shorting plate contained therein and except for openings to accommodate said tuning screws and any coupling screws.

6. A filter as claimed in any one of claims 1, 2 or 3 wherein there are at least two cavities and at least one of the cavities has a rectangular shape and the respective block has a similar rectangular shape corresponding to an interior of said corresponding cavity.

7. A filter as claimed in claim 1 wherein each dielectric resonator is held in contact with an associated shorting plate using a corresponding spring.

8. A filter as claimed in claim 7 wherein the associated shorting plate is comprised of a metallic material.

9. A filter as claimed in claim 8 wherein the associated shorting plate is comprised of high temperature superconductive thin films deposited on a dielectric substrate.

10. A filter as claimed in claim 8 wherein the associated shorting plate is comprised of high temperature superconductive thin film deposited on a dielectric substrate.

11. A filter as claimed in claim 1 wherein the dielectric resonators operate in a single mode that is selected from the group of a TEE mode and a TME mode.

12. A filter as claimed in claim 1 wherein the dielectric resonators operate in a dual HEE mode.

13. A filter as claimed in any one of claims 3, 7 or 9 wherein there are two cavities with one block in each cavity, each block containing two dielectric resonators and corresponding shorting plates, the dielectric resonators being operated in a mode selected from the group consisting of an HEE mode to realize an eight-pole dual-mode filter, a TEE mode to realize a four-pole single mode filter and a TME mode to realize a four-pole single mode filter, there being sufficient tuning screws and coupling screws as required, with means to control coupling between the resonators located within the same block and an iris containing an aperture located between said cavities to control coupling between resonators in different blocks, said blocks containing channels to receive said tuning and coupling screws.

14. A filter as claimed in any one of claims 1 or 2 wherein there are four cavities, with one block and a respective dielectric resonator and associated shorting plate mounted in each block, there being two irises, each iris having two sides, one iris being located between two of said cavities and another iris being located between said other cavities, each iris having an aperture with a shape to permit coupling between the dielectric resonators located on either side of said iris, the filter being operated in a mode selected from the group of an HEE mode to realize an eight-pole dual-mode filter, a TEE mode to realize a four-pole single mode filter and a TME mode to realize a four-pole single mode filter.

15. A filter as claimed in any one of claims 1, 2 or 3 wherein there are two blocks with two dielectric resonators mounted in one block and three dielectric resonators mounted in another block, an iris being located between said blocks, the coupling between resonators in adjacent blocks being controlled by an aperture located in the iris with means to control the coupling between resonators located in the same block.

16. A filter as claimed in any one of claims 1, 2 or 3 wherein there are two cavities, with each cavity containing two dielectric resonators and associated shorting plates contained in the respective block of each cavity.

17. A filter as claimed in any one of claims 1, 2 or 8 wherein there are four cavities with one dielectric resonator and associated shorting plate in each respective block, with one block being located in each cavity.

18. A filter as claimed in any one of claims 1, 2 or 3 wherein there are four cavities with two dielectric resonators and associated shorting plates being located in a respective block in each cavity, there being one block in each cavity.

19. A filter as claimed in any one of claims 1, 2 or 3 wherein the blocks are comprised of ceramic materials of low loss tangent selected from the group of D4 and sapphire.

20. A filter as claimed in any one of claims 1, 2 or 3 wherein the associated shorting plate has a dielectric substrate, said associated shorting plate having a surface that is in contact with a dielectric resonator, said surface having a plating of a material selected from the group of silver, gold and high temperature ceramic materials.

21. A filter as claimed in any one of claims 1, 2 or 3 wherein the associated shorting plate has a surface that contacts said dielectric resonator, said surface having a coating of a thin film layer of material selected from the group of yttrium barium copper oxide and thallium barium copper calcium oxide.

22. A filter as claimed in any one of claims 1, 2 or 3 wherein the associated shorting plate is comprised of a dielectric substrate selected from the group of lanthium aluminate and sapphire.

23. A filter as claimed in any one of claims 1, 2 or 3 wherein the dielectric resonator has a cylindrical shape and the associated shorting plate has a cross-sectional size sufficient to cover a cross-sectional area of said resonator.

24. A filter as claimed in any one of claims 1, 2 or 3 wherein the associated shorting plate has a surface adjacent the dielectric resonator having a coating of a high temperature superconductive film so that said filter can be operated a cryogenic temperatures.

25. A filter as claimed in claim 7 wherein the spring for each associated shorting plate is located between a cavity wall and the associated shorting plate to urge said associated shorting plate towards said respective resonator.

26. A method of operating a microwave filter having at least one cavity with a dielectric block disposed therein, with at least one dielectric resonator and associated shorting plate connected thereto, said dielectric resonator and associated shorting plate being located within said block, said block being sized and shaped relative to said cavity so that said block fits tightly within said cavity, said block having an interior that is sized and shaped to hold said dielectric resonator and said associated shorting plate within said block in a fixed position, said cavity resonating in at least one mode at its resonant frequency, there being sufficient tuning and coupling screws, said filter having an input and output, said block being made out of ceramic materials of low loss tangent, said associated shorting plate having a surface adjacent said resonator that is plated with high temperature ceramic materials that become superconductive at cryogenic temperatures, said method comprising lowering the temperature of said associated shorting plate to cryogenic temperatures, tuning said filter, raising the temperature of said associated shorting plate to room temperature, lowering the temperature of said shorting plate to cryogenic temperatures and operating said filter at cryogenic temperatures.

27. A method as claimed in claim 26 wherein the filter is operated to realize a result selected from the group of Chebyshev, elliptic and linear phase functions.

28. A filter as claimed in any one of claims 1, 2 or 3 wherein the respective blocks are comprised of ceramic materials.

* * * * *

UNITED STATES PATENT AND TRADEMARK OFFICE

CERTIFICATE OF CORRECTION

PATENT NO. : 5,498,771
DATED : March 12, 1996
INVENTOR(S) : Raafat R. Mansour

It is certified that error appears in the above-indentified patent and that said Letters Patent is hereby corrected as shown below:

Column 8, line 33 delete "110" and insert --94--.

Column 8, line 34 delete "14" and insert --13--.

Column 8, line 36 delete "110" and insert --94--.

Column 8, line 40 delete "110" and insert --94--.

Signed and Sealed this

Twenty-first Day of October 1997

*Attest:*

*Attesting Officer*

Bruce Lehman

BRUCE LEHMAN

*Commissioner of Patents and Trademarks*